US007005970B2

(12) United States Patent
Hodsdon et al.

(10) Patent No.: US 7,005,970 B2
(45) Date of Patent: Feb. 28, 2006

(54) OFFICIATING SYSTEM

(75) Inventors: Kelly P. Hodsdon, Aloha, OR (US); Bill Colson, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 378 days.

(21) Appl. No.: 10/037,658

(22) Filed: Jan. 3, 2002

(65) Prior Publication Data

US 2003/0122657 A1 Jul. 3, 2003

(51) Int. Cl.
*G08B 23/00* (2006.01)

(52) U.S. Cl. ..... 340/323 R; 340/539.13; 340/573.1; 382/103; 463/42; 473/476; 342/450; 348/157; 348/169

(58) Field of Classification Search ..... 340/573.1, 340/539.2, 539.13, 539.22, 572.1, 323 R; 382/103, 107; 463/1, 7, 42; 473/415, 476; 342/43, 450, 463, 42; 348/157, 159, 169; 273/237, 459, 460, 461
See application file for complete search history.

(56) References Cited

U.S. PATENT DOCUMENTS

| | | | | |
|---|---|---|---|---|
| 5,745,029 | A * | 4/1998 | Garcia | 340/323 R |
| 6,204,813 | B1 * | 3/2001 | Wadell et al. | 342/463 |
| 6,270,433 | B1 * | 8/2001 | Orenstein et al. | 473/467 |
| 6,520,853 | B1 * | 2/2003 | Suzuki | 463/7 |
| 6,567,038 | B1 * | 5/2003 | Granot et al. | 342/44 |
| 6,569,011 | B1 * | 5/2003 | Lynch et al. | 463/1 |
| 6,671,390 | B1 * | 12/2003 | Barbour et al. | 382/103 |
| 6,681,398 | B1 * | 1/2004 | Verna | 725/141 |
| 6,702,292 | B1 * | 3/2004 | Takowsky | 273/348 |
| 6,810,397 | B1 * | 10/2004 | Qian et al. | 707/6 |

* cited by examiner

*Primary Examiner*—Davetta W. Goins
(74) *Attorney, Agent, or Firm*—Blakely, Sokoloff, Taylor & Zafman LLP

(57) ABSTRACT

According to one embodiment, a method is disclosed. The method includes events based on observations extracted from input data and an event model. Input data from an event is fed into the system from a data source. Positional data is generated from the input data. Events are detected from the positional data, and stored as an event model in a database. A data extractor queries the database for officiating events and retrieves officiating event data from the database. The officiating event data is transmitted to an officiating entity of the event to assist the officiating entity in officiating the event.

25 Claims, 6 Drawing Sheets

120

OFFICIATING SYSTEM

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The present invention generally relates to a system and method for officiating an event. More specifically, the present invention relates to an automatic event detection system which may be used to officiate an event.

BACKGROUND

Many sports leagues, such as the Federation Internationale de Football Association (FIFA), the National Basketball Association (NBA), the National Football League (NFL), Major League Baseball (MLB) and the National Hockey League (NHL), rely on one or more officials, such as referees or umpires, to enforce the rules of the particular sport. Officials usually rely on their own perceptions of game events to make calls enforcing the rules of the game, and as such, are prone to human error. For various reasons, officiating persons may not see all of the activity occurring in the course of play and consequently may fail to notice a violation of the rules, or may even make an erroneous call. In some sports leagues, officials are able to consult replays of broadcast video footage to assist them in making close calls. However, due to the limited view and angle of broadcast cameras, some plays may still be obscured from the camera's view. Furthermore, a human is still required to interact and view the event in question, subjecting the call to the possibility of human error.

BRIEF DESCRIPTION OF THE DRAWINGS

The present invention will be understood more fully from the detailed description given below and from the accompanying drawings of various embodiments of the invention. The drawings, however, should not be taken to limit the invention to the specific embodiments, but are for explanation and understanding only.

DETAILED DESCRIPTION

Figure 1:
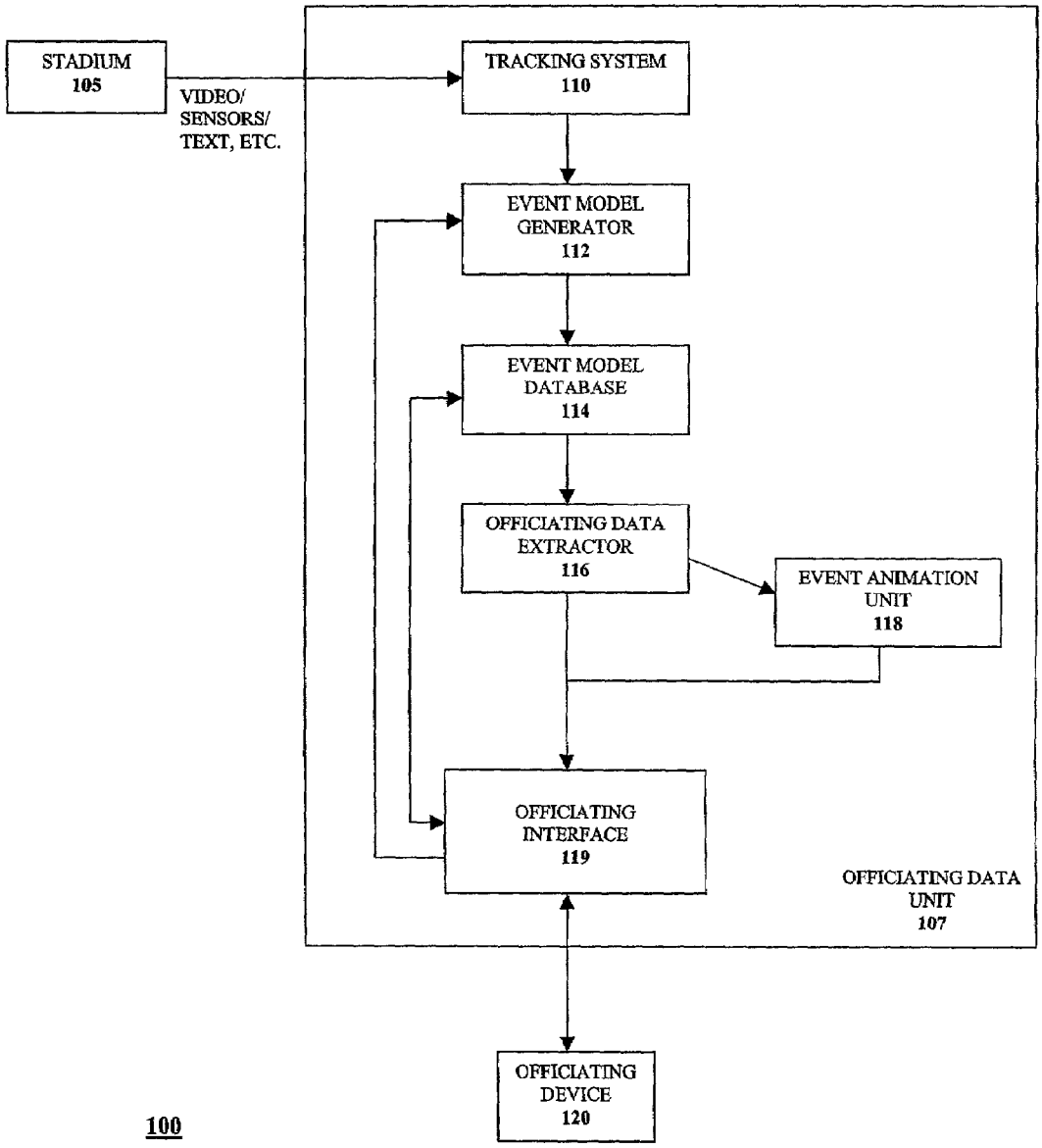
FIG. 1 illustrates one embodiment of a high level block diagram of an officiating system.

FIG. 1 illustrates one embodiment of an officiating system 100. Officiating system 100 automatically detects semantic events to aid in the officiating of sporting events. Semantic events are game-rule type events that occur during a sporting event. For example, in a soccer game, an off-sides penalty would be a semantic event. In one embodiment, officiating system 100 includes an officiating data unit 107 and an officiating device 120. Officiating data unit 107 detects semantic events and generates officiating data which may be transmitted to an officiating device 120.

Officiating data unit 107 includes a tracking system 110, an event model generator 112, an event model database 114, an officiating data extractor 116, an event animation unit 118 and an officiating interface 119. Tracking system 110 tracks mobile objects (objects which move with respect to the field of play in a sporting event, e.g. players, officials, a ball or puck) or elements of the sporting event within a stadium 105 or field of play.

In one embodiment, tracking system 110 receives and processes input data, and generates tracking data (positional information) therefrom. Tracking data may be generated in a number of ways using passive and/or active methods. Passive methods include methods such as video based tracking, while active methods include methods such as manual input of data, RF and microwave based tracking. In one embodiment, the input data may include video provided from at least one video camera in stadium 105 where the sporting event takes place. A plurality of video cameras may also be utilized to capture the sporting event from different views and angles which may then be provided to tracking system 110.

According to one embodiment, the input data video includes numerous video footages from various video cameras located at different positions in stadium 105. In a further embodiment, radio frequency (RF) beacons are utilized to obtain the tracking information. RF beacons may be placed on mobile objects to track movement through the course of the sporting event via RF transmitters and RF receiver(s) at stadium 105. In another embodiment, microwave tracking may be used as input data. In yet another embodiment, manual input of data relating to or describing the sporting event, such as a player injury, may be provided as input data.

In another embodiment, Global Positioning System (GPS) devices are used to track mobile objects in the game. Other forms of tracking may include transmitters and transponders of various types. Moreover, textual information relating to or describing events of the sporting event may also be provided as input data. In other embodiments, a combination of video, RF beacons, microwave tracking, manual input, textual information, and/or other tracking means, may be provided as input data. Tracking system 110 processes the input data to determine the position of mobile objects.

In one embodiment, the tracking information is obtained by utilizing software applications that analyze the input data (e.g., frames of the input data video, RF signals, microwave tracking, GPS, manual input and/or textual information to identify each mobile object (player, official, ball or puck, etc.) in stadium 105, field, or court of play, and to track each mobile object throughout the course of the sporting event. Tracking system 110 may include a combination of frame (digitizing) "grabbers" and other software applications to capture frames of a video feed for analysis, to determine the locations of the RF beacons from the RF signals therefrom, and to interpret any microwave tracking, manual input or textual information provided.

The software applications may recognize each element of the sporting event from the input data and track their course throughout the sporting event. Imaging recognition algorithms may be implemented in these software applications to assist in identifying and tracking the elements of a sporting event. For example, a software application utilizing image recognition algorithms may be able to analyze the input data video and identify a player based on the color of the jersey, the number on the jersey, the name printed on the jersey, the size of the player, the shape of the player, the player's face, etc., or any combination thereof.

Moreover, a human operator may also be utilized to assist in identification and/or tracking of the elements of a sporting event as well. Video tracking hardware and software algorithms may be utilized to track the elements of a sporting event, such as those by Sport Universal of Plan Du Var, France, which develops software applications for tracking soccer players. When combined with RF-based tracking systems, such as those developed by Trakus of Medford, Mass., for tracking objects in hockey games, along with textual information about the sporting event, the tracking information that is obtained may be more accurate.

In one embodiment, the tracking information is a data file storing primarily numeric values corresponding to x, y, z coordinate information for each element (player, official, ball or puck, etc.) of the sporting event within stadium 105, field, or court of play. The coordinate information for each element of the sporting event may be stored on a frame-by-frame basis, such as by time codes. The x, y, z coordinate information for each element of the game may be relative to stadium 105, field or court of play. The tracking information may be a static file, or a streaming file, generated in real-time as the game is progressing.

Event model generator 112 receives the tracking information from tracking system 110 and generates event model information that includes both semantic information and geometric information. The event model information may be in the Extensible Markup Language (XML) schema definition language (World Wide Web Consortium recommendation, May 2, 2001), or another suitable format. XML allows developers to create customized tags that organize and deliver content efficiently.

According to one embodiment, event model generator 112 utilizes software algorithms to automatically detect and add events and actions/motions to the event model information based on the tracking information provided by tracking system 110. The software applications of event model generator 112 may include the rules and specifics of a particular sporting event so that it determines from the tracking information all the statistical information that is to be recorded for the sporting event, including event occurrences, player actions, team actions, plays executed, points scored, penalties, etc.

Figure 2:
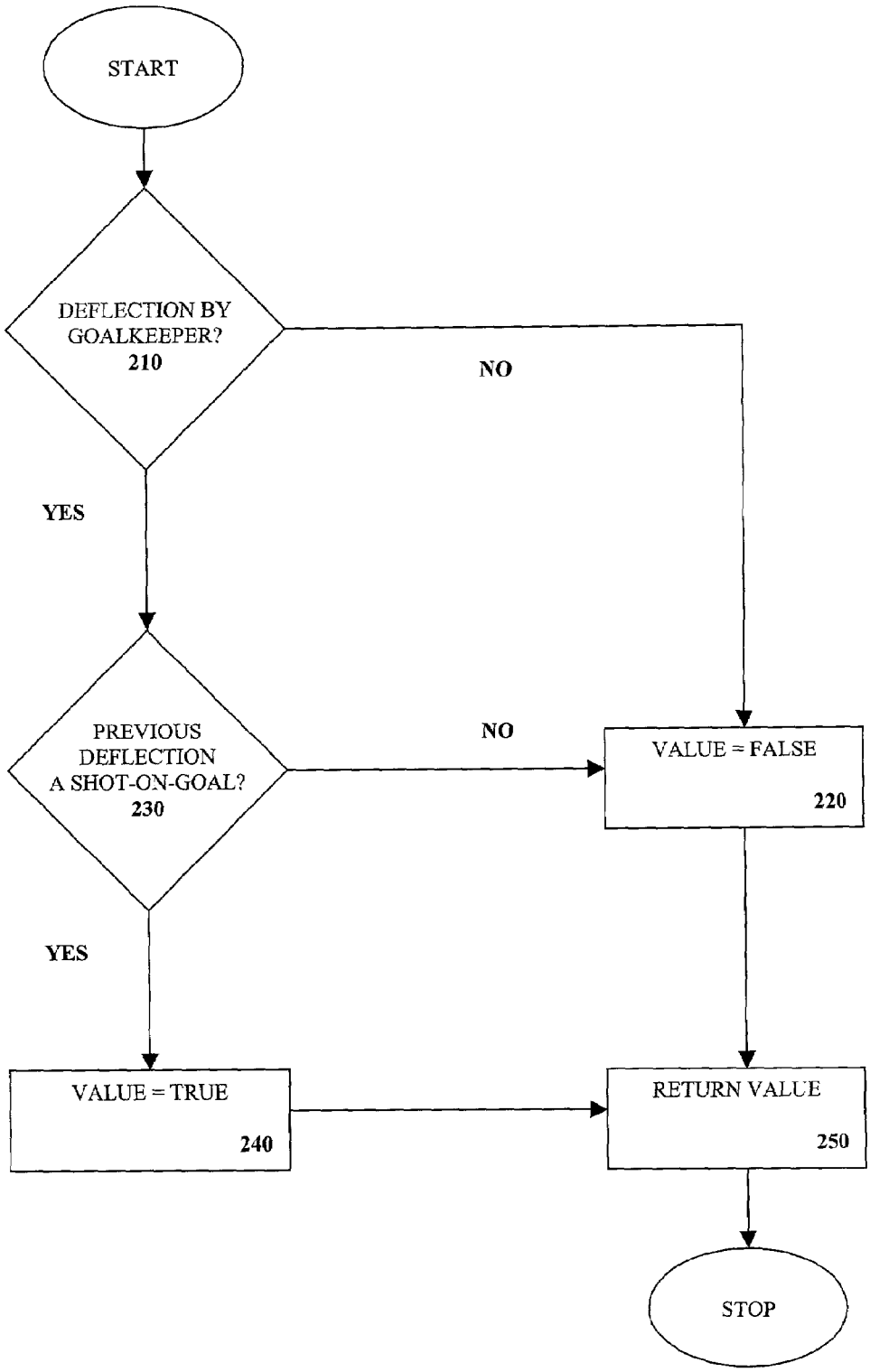
FIG. 2 is a flow diagram for one embodiment of a detection algorithm.

FIG. 2 illustrates one embodiment of a flow diagram for a mechanism that event model generator 112 may use for detecting a "Save" event in a soccer game. For example, a "Save" event in a soccer game is when a goalkeeper has "saved" a shot-on-goal from becoming a goal. At processing block 210, a determination is made whether the ball was deflected by the goalkeeper. If the ball was not deflected, the value for the "Save" event is false, processing block 220, and a false value is returned, processing block 250. If the ball was deflected by the goalkeeper, then a determination is made of whether the previous deflection was a shot-on-goal, processing block 230. If the deflection was not a shot on goal, the value for the "Save" event is false, processing block 220, and a false value is returned, processing block 250. If the previous shot was a shot-on-goal, the value for the "Save" event is true, processing block 240, and a true value is returned, processing block 250, indicating that a "Save" event occurred. In one embodiment, event model generator 112 accounts for all of the details of a sporting event based only on the tracking information provided thereto. A human production operator also may be able to view the event model information and insert or edit the events and motions, if necessary, to provide greater accuracy and flexibility for the entire system.

Referring again to FIG. 1, an event model database 114 receives and stores event model information from event model generator 112. An event model includes the event model information stored in event model database 114. The event model is a digital representation of the sporting event, including every event that occurs in the sporting event, as well as positional information on every mobile object throughout the course of the sporting event. As the sporting event proceeds, the event model may be added to, subtracted from, corrected, updated or otherwise altered by new event model information received from event model generator 112. Event model database 114 may be queried by various applications for different purposes, such as generating three dimensional highlights, replays, statistics, animations etc.

In one embodiment, the event model includes both semantic and geometric information. The semantic information of the event model is derived from the tracking information and typically includes higher-level semantic information describing game-rule type events that occur during a sporting event. For example, a soccer game includes a series of player actions and player-ball or player-player interactions. Some of these actions or interactions lead to certain consequences (e.g., off-sides, a goal or a penalty kick) as determined by the rules of soccer.

In general, certain types of actions or interactions may be considered as semantically significant in the meaning of the game (e.g., off-sides, out-of-bounds, or a corner-kick), while others may be considered as simple physical motion (e.g., running alone without the ball). The event model emphasizes the description of the semantically significant events, actions, interactions, and consequences, which may be universally called "events". Events such as off-sides, a committed foul, a player kicking a ball, performing a corner kick, scoring a goal, an interception, along with the time of occurrence for each event and the player(s) involved, are examples of semantic information that may be included with the event model information. As discussed above, the event model information may be stored as an XML document so as to enable XML queries to be performed.

The geometric information is also derived from the tracking information and typically includes information on the actions and motions of the mobile objects (players, official, ball or puck, etc.) of the sporting event. The geometric information is at a higher level than and also includes the x, y, z coordinate information of the tracking information (e.g., the geometric information is a superset of the x, y, z, coordinate information). However, the geometric information is at a lower level than the semantic information found in the event model. For example, the information concerning the actions and motions of the elements of the sporting event, also known as geometric information, may include: a player kicking a ball, a player running without a ball, a player moving from one side of the field to another, the movement of a ball, the movement of a player (e.g., speed and direction), etc.

The semantic information and the geometric information may include the same information since there may be overlap between the two types of information. The geometric information is typically lower-level information, which includes movement, direction, speed, etc., as well as the motions and actions performed to execute a play. Semantic information is usually higher-level information, such as describing an executed play itself, rather than the actions and motions that make up the play, which would typically be described by the geometric information.

Officiating data extractor 116 may query event model database 114 for officiating event data. Officiating event data includes both semantic information and geometric information relating to an officiating event. An officiating event is a game-rule type event which is significant in the course of the sporting event, and which an official (e.g. referee, umpire, etc.) would typically be responsible for determining whether an infringement of the rules has occurred. For example, officiating events in a soccer game may include events such as off-sides, fouls, out-of-bounds, a goal, etc.

When officiating event data is located in event model database 114, officiating event data is read by officiating data extractor 116. Officiating data extractor 116 may continuously query event model database 114 throughout the course of the sporting event, so that officiating events are located by officiating data extractor 116 in real-time. When an officiating event is located by officiating data extractor 116, semantic and geometric information relating to the officiating event are read by officiating data extractor 116.

In one embodiment, geometric information relating to the located officiating event is transferred from officiating data extractor 116 to event animation unit 118. Event animation unit 118 generates an event animation of the officiating event, based on the geometric information stored in event model database 114. The event animation may be two dimensional or three dimensional, and may be formatted to provide views of an officiating event from more than one angle. For example, if the located officiating event is an out-of-bounds event in a soccer game, an animation may be generated which provides a three dimensional view of the area of the field where the ball went out-of-bounds, and which would allow a user to view the animation from any-angle, and be able to zoom in and out of the event animation. Moreover, a user may even view the event from a player's perspective. The animation may also provide video or animation replays, as well as audio playback.

Officiating interface 119 serves as a communication interface for receiving, routing, and transmitting data. Officiating interface 119 receives semantic information relating to an officiating event from officiating data extractor 116. Officiating interface 119 also receives an event animation generated by event animation unit 118. Officiating interface 119 may transmit the semantic information relating to the located officiating event to officiating device 120. The event animation generated for the located officiating event may also be transmitted from officiating interface 119 to officiating device 120.

In one embodiment, officiating device 120 receives semantic information and an event animation relating to a located officiating event, wherein the information and the animation are used to aid an officiating entity (e.g. referee or umpire) in officiating the sporting event. In one embodiment, officiating interface 119 communicates with officiating device 120 wirelessly, for example, via the IEEE 802.11b standard, IEEE Std. 802.11b-1999, published Jan. 20, 2000. Officiating device 120 may include a display unit, and at least one input device, such as a button, a keyboard, or a stylus/touch-screen combination.

In one embodiment, when an officiating event is located and read by officiating data extractor 116, the semantic information and the event animation relating to the located officiating event are transmitted to officiating interface 119, then transmitted wirelessly to officiating device 120. In another embodiment, officiating interface 119 communicates with officiating device 120 via a wire.

Figure 3:
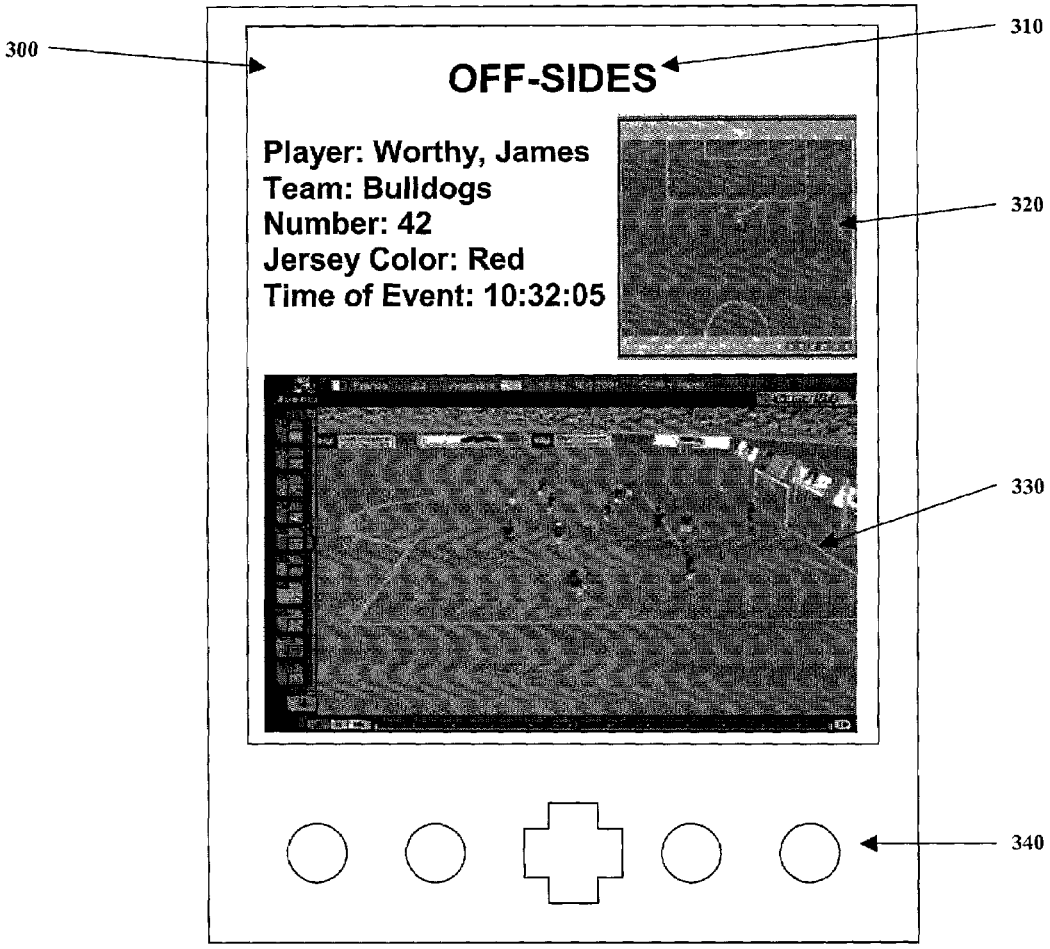
FIG. 3 illustrates one embodiment of an officiating device.

FIG. 3 illustrates one embodiment of officiating device 120 receiving semantic information of an off-sides event in a soccer game. According to one embodiment, a display unit 300 of officiating device 120 displays, among other items, the type of officiating event that occurred 310 (e.g. off-sides), the name and number of the player(s) involved in the officiating event, the jersey color of the offending player, a representation of where on the field of play the officiating event occurred 320, and an animation of the officiating event which may be played back and viewed from any angle 330. Officiating device 120 may also have controls 340, similar to a VCR remote, to enable a user of the officiating device to replay, rewind or fast-forward an animation and to view the game from any angle.

In one embodiment, officiating device 120 transmits data to officiating interface 119. Officiating device 120 may be used to query event model database 114 to obtain various information. For example, a referee in a soccer game may use officiating device 120 to query event model database 114 to determine how many fouls a player has received, to request an animation playback of a questionable play, or even to communicate with other referees or officials. In another embodiment, an officiating entity may enter officiating decision data into officiating device 120.

Officiating decision data is data which relates to a decision made by an officiating entity. For example, in a soccer game, if a referee decides that off-sides has occurred, he may input his decision into officiating device 120. The off-sides decision input into officiating device 120 is officiating decision data. Officiating device 120 may then transmit the officiating decision data to officiating interface 119, wherein officiating interface 119 transmits the officiating decision data to event model generator 112, wherein event model generator 112 incorporates the officiating decision data into the event model.

Figure 4:
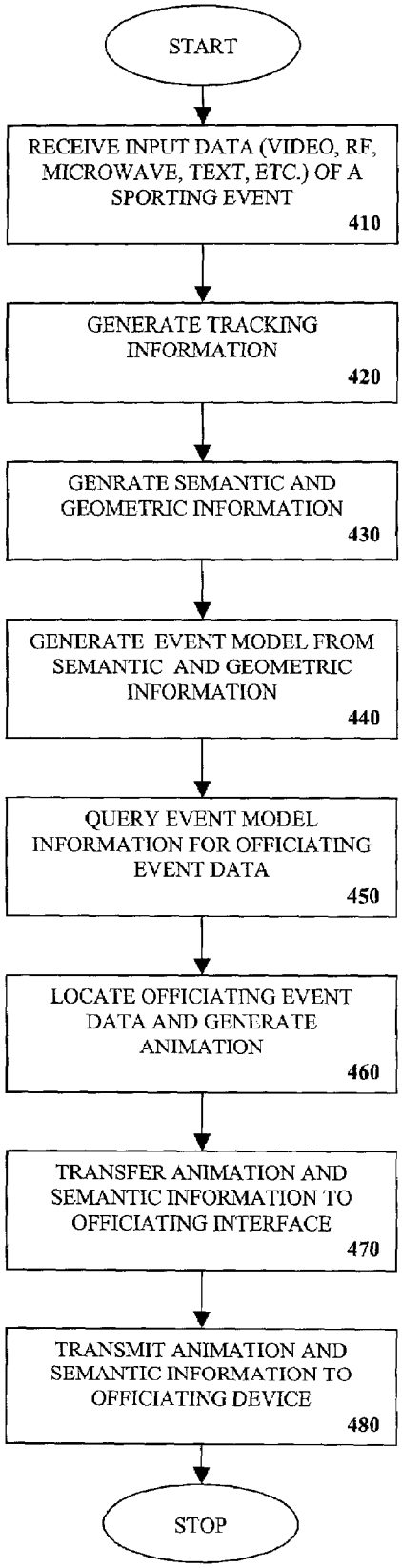
FIG. 4 illustrates one embodiment of a block diagram of a computer system.

FIG. 4 is a flow diagram for one embodiment for the operation of officiating system 100. At processing block 410, input data of a sporting event is received at tracking system 110. At processing block 420, tracking system 110 generates tracking information that is received at event model generator 112. At processing block 430, event model generator 112 detects events and generates semantic and geometric information. At processing block 440, the event model is generated from the semantic and geometric information.

At processing block 450, officiating data extractor 116 queries the event model database 114 for officiating event data. When officiating event data is located, an animation of the officiating event is generated, processing block 460. At processing block 470, the animation and semantic information relating to the officiating event are transferred to officiating interface 119. At processing block 480, the animation and semantic information relating to the officiating event are transmitted to an officiating device 120.

Figure 5:
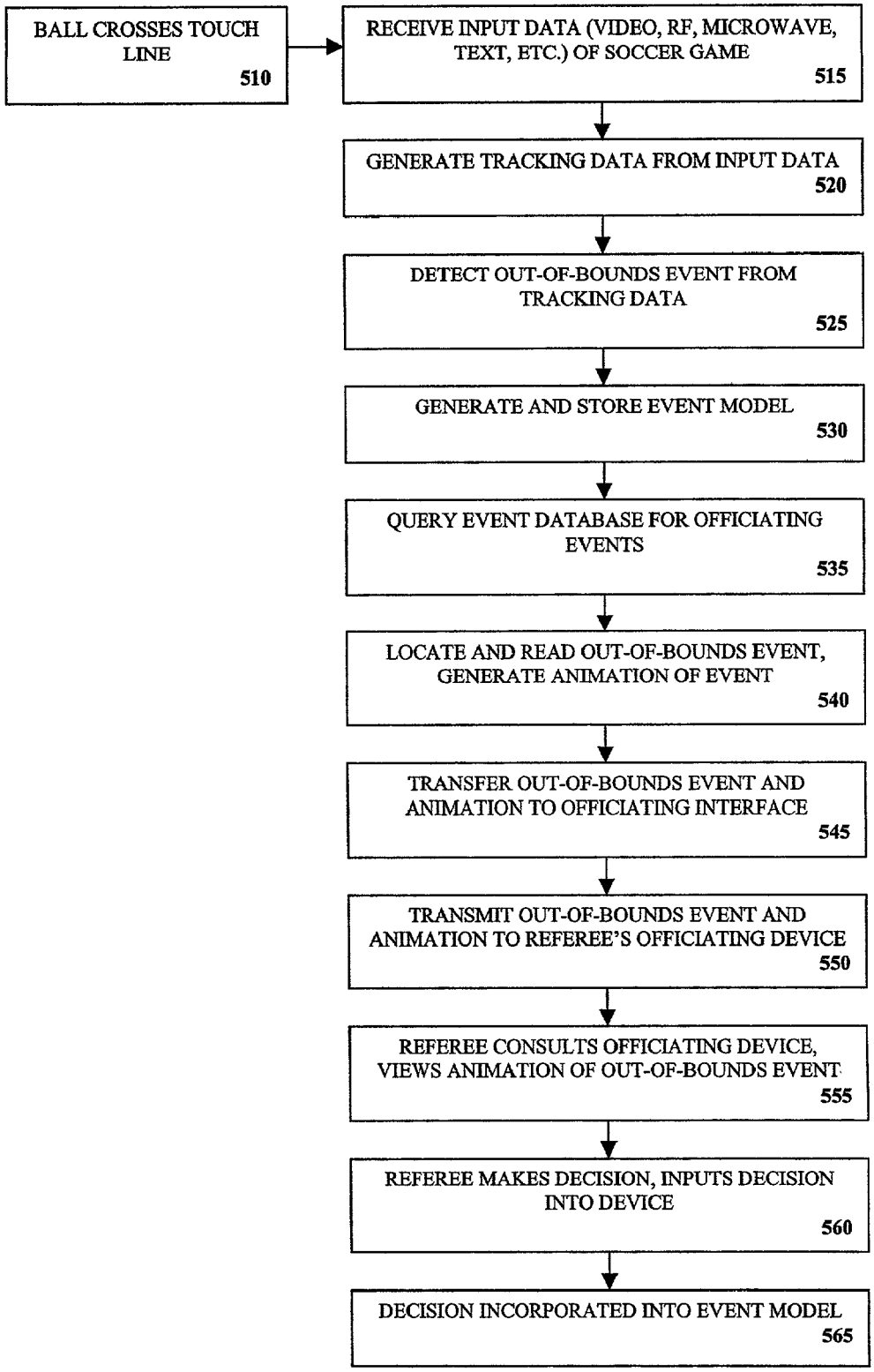
FIG. 5 is a diagram for one embodiment of the operation of an officiating system.

FIG. 5 illustrates one embodiment of a flow diagram of officiating system 100 used to assist a referee in officiating a soccer game. The field of play in a soccer game is rectangular and marked by lines. The two longer boundary lines which form the sides of the field are called touch lines. The two shorter lines which form the ends of the rectangle are called goal lines. An out-of-bounds event occurs when the ball has wholly crossed a touch line or a goal line, whether on the ground or in the air.

At processing block 510, an out-of-bounds event occurs on the field when the ball crosses a touch lines. At processing block 515, input data of the out-of-bounds event in the form of video data and/or RF or microwave sensors is received by tracking system 110. At processing block 520, tracking system 110 generates tracking data from the input data, which is then transmitted to event model generator 112.

At processing block 525, event model generator 112 automatically detects the out-of-bounds event and adds the out-of-bounds event, as well as the geometric information relating to it, to an event model. At processing block 530, the event model is stored in event model database 114 in XML format. At processing block 535, officiating data extractor 116 queries event model database 114 for officiating events. At processing block 540, data extractor 116 locates and reads the out-of-bounds event from event model database 114 and generates an animation of the event. At processing block 545, the out-of-bounds event and animation are then transmitted to officiating interface 119. At processing block 550, the out-of-bounds event and animation are transmitted to officiating device 120.

In one embodiment, officiating device 120 is in the possession of the referee. In a further embodiment, when a transmission from officiating interface 119 is received by officiating device 120, officiating device 120 notifies the referee via a flashing light, noise, or vibration, that an officiating event has occurred. The display unit 300 of officiating device 120 displays a text notification reading "Out-of-bounds". Display unit 300 also provides the name, number, and team of the player who last made contact with the ball, as well as an animation of the contact that led to the ball going out-of-bounds, including zoom capabilities and multiple views, perspectives and angles of the event.

At processing block 555, the referee consults the animation to determine whether the ball went out-of-bounds, and which team last made contact with the ball. In this example, the referee determines that the ball did in fact go out-of-bounds, and accordingly makes a call against the team who last made contact with the ball prior to the out-of-bounds event. At processing block 560, the referee inputs his decision into officiating device 120, wherein the officiating decision data is then transmitted from officiating device 120 to officiating interface 119. At processing block 565, officiating interface 119 transfers the officiating decision data to event model generator 112, where the officiating decision data is incorporated into the event model.

Figure 6:
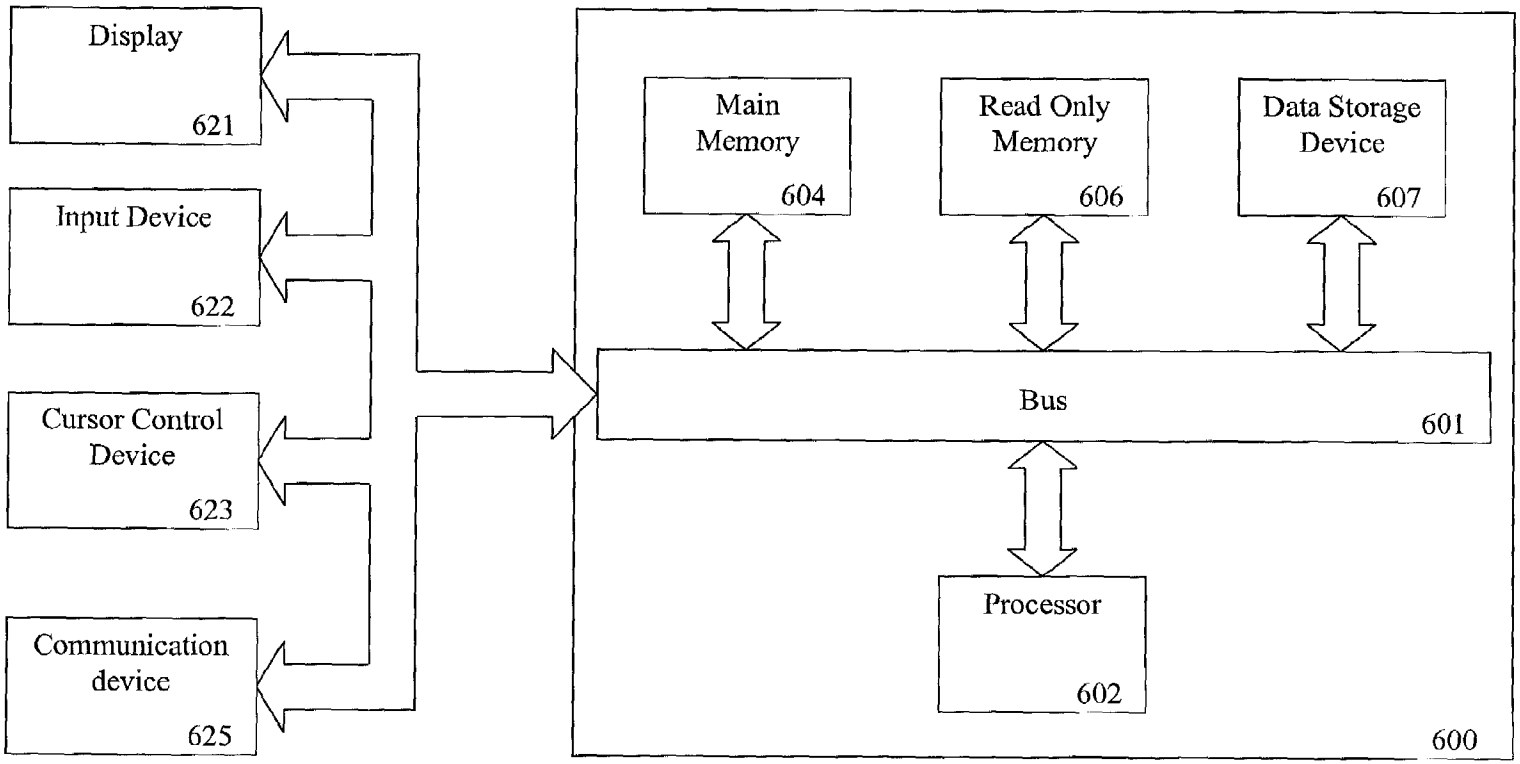
FIG. 6 is a flow diagram for one embodiment of the use of an officiating system.

FIG. 6 is a block diagram of an exemplary computer system 600. Computer system 600 may be used to implement officiating data unit 107 and/or officiating device 120. Computer system 600 includes a bus or other communication means 601 for communicating information, and a processing means such as processor 602 coupled with bus 601 for processing information. For example, officiating data unit 107 may include a processor 602 in any of the Pentium®, Itanium®, or the Pentium Xeon® families of processors, all available from Intel Corporation of Santa Clara, Calif. In one embodiment, processor 602 may be based on Intel processor architecture, such as Intel® IA-32 or Intel® IA-64 architecture. Alternatively, other processors and architectures may be used. For example, in one embodiment, officiating device 120 may include a processor 602 in the Intel® StrongARM family.

Computer system 600 further includes a random access memory (RAM) or other dynamic storage device 604 (referred to as main memory), coupled to bus 601 for storing information and instructions to be executed by processor 602. Main memory 604 also may be used for storing temporary variables or other intermediate information during execution of instructions by processor 602. Computer system 600 also includes a read only memory (ROM) and/or other static storage device 606 coupled to bus 601 for storing static information and instructions for processor 602.

A data storage device 607 such as a magnetic disk or optical disc and its corresponding drive may also be coupled to computer system 600 for storing information and instructions. For example, in one embodiment of officiating data unit 107, the event model data may be stored on data storage device 607. Computer system 600 can also be coupled via bus 601 to a display device 621, such as a Liquid Crystal Display (LCD) or cathode ray tube (CRT) for displaying information to an end user. For example, in one embodiment of officiating device 120, graphical and/or textual indications of game events and other information may be presented to an end user on the display device 621.

Typically, an input device 622, including alphanumeric and other keys, may be coupled to bus 601 for communicating information and/or command selections to processor 602. In one embodiment, input device 622 may include a stylus/touch-screen combination. Another type of user input device is cursor control device 623, such as a mouse, a trackball, or cursor direction keys for communicating direction information and command selections to processor 602 and for controlling movement of a cursor display 621.

A communication device 625 is also coupled to bus 601. The communication device 625 may include a modem, a network interface card, or other well known interface devices, such as those used for coupling to Ethernet, token ring, or other types of attachments for purposes of providing a communication link to support a local or wide area network, for example. Communication device 625 may include wireless interface devices such as a wireless modem or wireless network interface card. Other well known wireless interface devices may be used for wireless communication between officiating interface 119 and officiating device 120. In any event, in this manner, the computer system 600 may be coupled to a number of clients and/or servers via a conventional network infrastructure, such as an Intranet and/or the Internet, for example.

It is appreciated that a lesser or more equipped computer system than the example described above may be desirable for certain implementations. For example, a wireless enabled handheld device, such as a wireless enabled IPAQ Pocket PC, available from Compaq Computer Corporation of Houston, Tex., or another handheld computing system, such as those available from Palm, Inc. of Santa Clara, Calif., may be suitable platforms from which officiating device 120 may be implemented. Therefore, the configuration of computer system 600 will vary from implementation to implementation depending upon numerous factors, such as price constraints, performance requirements, technological improvements, and/or other circumstances.

It should be noted that, while the steps described herein may be performed under the control of a programmed processor, such as processor 602, in alternative embodiments, the steps may be fully or partially implemented by any programmable or hard coded logic, such as Field Programmable Gate Arrays (FPGAs), TTL logic, or Application Specific Integrated Circuits (ASICs), for example. Additionally, the operation of officiating device 120 may be performed by any combination of programmed general purpose computer components and/or custom hardware components. Therefore, nothing disclosed herein should be construed as limiting the present invention to a particular embodiment wherein the recited steps are performed by a specific combination of hardware components.

While the description above refers to particular embodiments of the present invention, it will be understood that many modifications may be made without departing from the spirit thereof. For example, the officiating system described herein may be applied to any sport or game, such as for example tennis, hockey, volleyball, basketball, golf, American football, regardless of whether or not the sporting events are associated with a recognized league. In addition, the no components making up the officiating system may reside in a single system or multiple systems, and may be in the form of software applications which may be ran on a computer, or may be embedded in hardware. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A method comprising:

receiving input data of a sporting event;

processing said input data to generate positional data;

generating semantic information based on said positional data and game rules of said sporting event, said semantic information describing an officiating event indicating a potential infraction of one or more rules of the sporting event; and transmitting said semantic information to a wireless officiating device possessed by an officiating entity of said sporting event, said transmitting to notify said officiating entity of said officiating event.

2. A method according to claim 1, wherein said sporting event is a soccer game.

3. A method according to claim 1, wherein said officiating entity is an event official.

4. A method according to claim 1, further comprising:

generating an event model from said positional data and said semantic information; and storing said event model in an event model database.

5. A method according to claim 4, further comprising querying said event model database for said officiating event.

6. A method according to claim 1, further comprising generating an animation based on said positional data.

7. A method according to claim 6, further comprising transmitting said animation to said officiating device.

8. A method according to claim 1, further comprising transmitting said semantic information to an officiating interface.

9. A system comprising:

an officiating data unit to generate officiating event data based on positional data and game rules of a sporting event, said officiating event data describing an officiating event indicating a potential infraction of one or more rules of said sporting event; and a wireless officiating device to receive said officiating event data, said officiating device to notify an officiating entity of said officiating event.

10. The system of claim 9, wherein said officiating data unit comprises a tracking system to receive input data and generate said positional data from said input data.

11. The system of claim 10, wherein said officiating data unit comprises:

an event model generator to generate an event model from said positional data; and an event model database to store said event model.

12. The system of claim 11, wherein said officiating data unit comprises:

an officiating data extractor to query said event model database for said officiating event data; and an officiating interface to receive said officiating event data and transmit said officiating event data to said officiating device.

13. The system of claim 12, wherein said officiating interface receives officiating decision data from said officiating device.

14. The system of claim 13, wherein said event model includes said officiating decision data.

15. The system of claim 9, further comprising an event animation unit to generate an animation from said officiating event data.

16. The system of claim 15, further comprising an officiating interface to receive said animation and transmit said animation to said officiating device.

17. The system of claim 15, wherein said officiating device receives said animation.

18. A machine-readable medium having stored thereon data representing sequences of instructions, said sequences of instructions which, when executed by a processor, cause said processor to:

receive input data of a sporting event;

process said input data to generate positional data;

generate semantic information based on said positional data and game rules of said sporting event, wherein said semantic information describes an officiating event indicating a potential infraction of one or more rules of the sporting event; and transmit said semantic information to a wireless officiating device possessed by an officiating entity of said sporting event, said transmitting to notify said officiating entity of said officiating event.

19. The machine-readable medium of claim 18, wherein said sporting event is a soccer game.

20. The machine-readable medium of claim 18, wherein said officiating entity is a referee.

21. The machine-readable medium of claim 18, wherein said sequences of instructions further cause said processor to:

generate an event model from said positional data and said semantic information; and store said event model in an event model database.

22. The machine-readable medium of claim 21, wherein said sequences of instructions further cause said processor to query said event model database for officiating event data.

23. The machine-readable medium of claim 18, wherein said sequences of instructions further cause said processor to generate an animation based on said positional data.

24. The machine-readable medium of claim 23, wherein said sequences of instructions further cause said processor to transmit said animation to said officiating device.

25. The machine-readable medium of claim 18, wherein said sequences of instructions further cause said processor to transmit said semantic information to an officiating interface.

* * * * *

UNITED STATES PATENT AND TRADEMARK OFFICE

CERTIFICATE OF CORRECTION

PATENT NO. : 7,005,970 B2
APPLICATION NO. : 10/037658
DATED : February 28, 2006
INVENTOR(S) : Hodsdon et al.

It is certified that error appears in the above-identified patent and that said Letters Patent is hereby corrected as shown below:

In column 8, at line 60, delete “no”.

Signed and Sealed this

Twentieth Day of November, 2007

JON W. DUDAS
*Director of the United States Patent and Trademark Office*